US005906427A

United States Patent [19]

Noh

[11] Patent Number: 5,906,427

[45] Date of Patent: May 25, 1999

[54] FLUORESCENT LAMP

[75] Inventor: Shi Youl Noh, Seoul, Rep. of Korea

[73] Assignee: Boam R & D Co., Ltd., Kyonggido, Rep. of Korea

[21] Appl. No.: 08/801,404

[22] Filed: Feb. 20, 1997

[51] Int. Cl.[6] ..... F21S 3/00

[52] U.S. Cl. ..... 362/223; 362/219; 362/221; 362/222; 362/375

[58] Field of Search ..... 362/217, 221, 362/222, 223, 219, 374, 375

[56] References Cited

U.S. PATENT DOCUMENTS

| | | | |
|---|---|---|---|
| 3,086,105 | 4/1963 | Termann | 362/219 |
| 3,120,929 | 2/1964 | Henning | 362/219 |
| 3,299,264 | 1/1967 | Lipscomb | 362/219 |
| 3,349,237 | 10/1967 | Jackson | 362/219 |
| 3,375,322 | 3/1968 | Serio et al. | 362/219 |
| 4,726,781 | 2/1988 | Bernhart et al. | 362/219 |
| 5,521,805 | 5/1996 | Lim . | |

*Primary Examiner*—Thomas M. Sember
*Attorney, Agent, or Firm*—Jacobson, Price, Holman & Stern, PLLC

[57] ABSTRACT

A fluorescent light fixture that includes a lamp assembly having a circuit board therein where various components for the lamp's operation are provided; lamp fixing members for connecting the lamp by inserting them into both ends of the lamp assembly; an upper cover covering the top surface of the lamp assembly; a connector connected to the lamp fixing member through an installation groove at one end of the lamp assembly; and a coupler coupling a multiple connectors. Therefore, the lamp has an improved structure of the lamp assembly in order to allow the lamp itself to be replaced, and improved connections between the lamp assemblies.

7 Claims, 4 Drawing Sheets

FLUORESCENT LAMP

BACKGROUND OF THE INVENTION

1. Field of the Invention

The present invention relates to a small diameter fluorescent lamp, specifically, to a fluorescent lamp of a small diameter for ornamental purposes (to provide visual effects) as well as for simple illumination.

2. Discussion of Related Art

Generally, fluorescent lamps with large diameter tubes are used for illuminating interiors. Conventional fluorescent lamps are not suitable for ornamental illumination and for minimizing space occupied, or indirect illumination. Accordingly, a fluorescent lamp with a small diameter, disclosed in U.S. Pat. No. 5,521,805 and owned by the Applicant, was devised in order to solve the above-mentioned problems.

The fluorescent lamp disclosed in U.S. Pat. No. 5,521,805 has a construction where the fluorescent lamp is integral with a lamp assembly so that the lamp assembly as well as the fluorescent lamp must be replaced at the end of the lamp service life, or when the lamp fails.

Also, the fluorescent lamp has a construction which conveniently allows connecting multiple lamps in series by using female and male connectors made of plastic. This results in regular lamp spacing in applications using an array of multiple lamps. Therefore, the connecting portion which is apparently cut off does not present a fine exterior.

In addition, the connectors made of soft plastics contract and expand from the heat of the lamp, resulting in poor electrical contact between the terminals, hence, frequent extinguishment of the lamp.

When one of the serially connected lamp assemblies is replaced because of a defect, the lamp assemblies also must be disassembled and replaced.

SUMMARY OF THE INVENTION

Accordingly, the present invention is directed to a fluorescent lamp that substantially obviates one or more of the problems, limitations, and disadvantages of the related art.

An objective of the present invention is to solve the above-mentioned problems and thus to create a fluorescent lamp with a construction amicable to convenient connecting and replacement of lamp assemblies, and possible replacement of fluorescent lamps only.

Additional features and advantages of the invention will be set forth in the description which follows, and in part will be apparent from the description, or may be learned by practice of the invention. The objectives and other advantages of the invention are realized by the structure of the invention, and are detailed in the written description and claims hereof as well as the appended drawings.

To achieve these and other advantages and in accordance with the objective of the present invention, as embodied and broadly described, a fluorescent lamp includes: a lamp assembly having a printed circuit board containing various components for the lamp's operation; a lamp fixing member for fixing the lamp by inserting it to both ends of the lamp assembly; an upper cover covering the top surface of the lamp assembly; a connector connected to the lamp fixing member through an installation groove at one end of the lamp assembly; and a coupling member coupling multiple connectors.

It is to be understood that both the foregoing general description and the following detailed description are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention, and together with the description serve to explain the principles of the invention:

DETAILED DESCRIPTION OF PREFERRED EMBODIMENT

Figure 1:
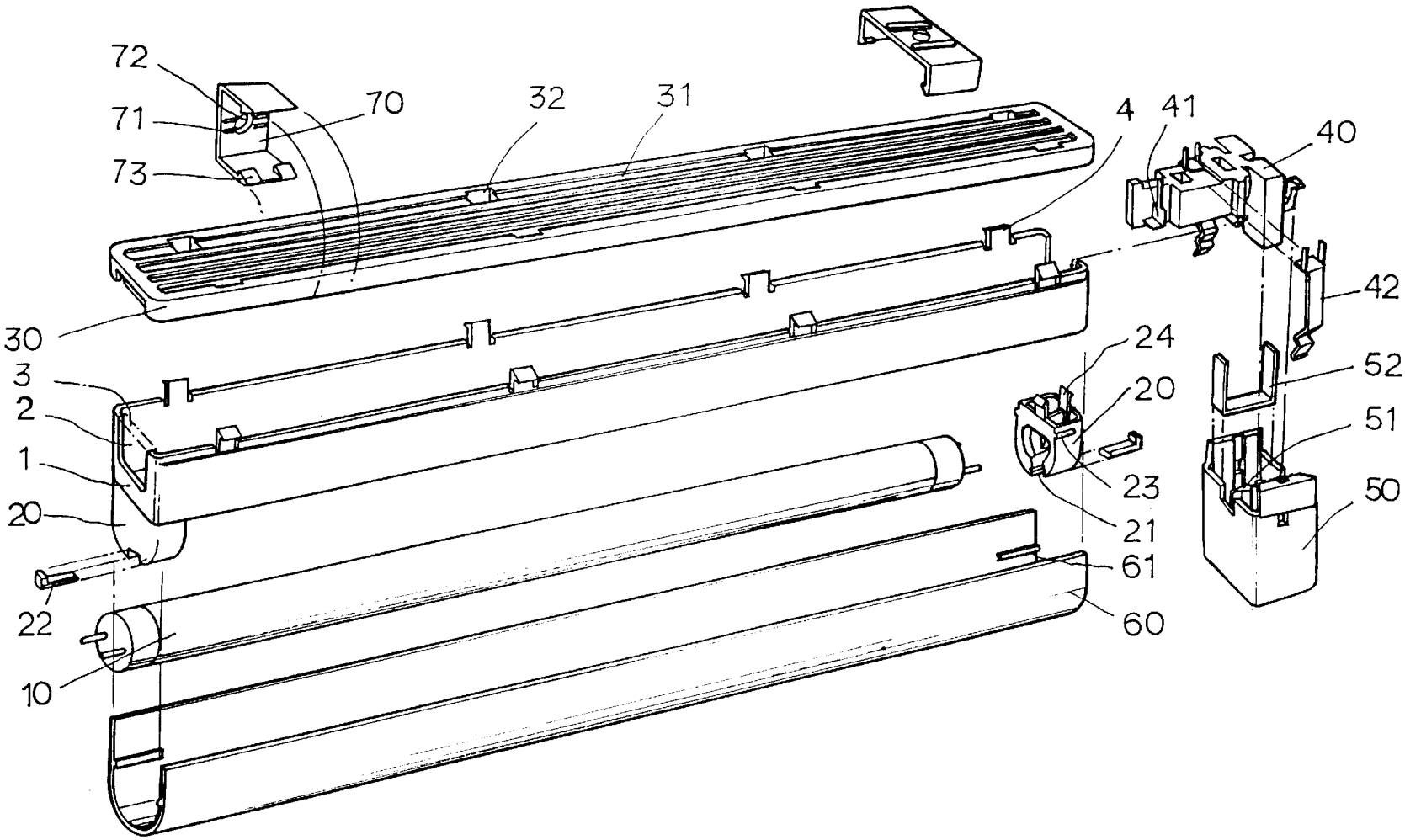
FIG. 1 is an exploded perspective view of one embodiment of the present invention.

Reference will now be made in detail to the preferred embodiments of the present invention, examples of which are illustrated in the accompanying drawings.

The fluorescent lamp of the present invention basically has components that are similar to a conventional fluorescent lamp's. That is to say, the lamp comprises a lamp assembly 1 having a circuit board therein, a lamp fixing member 20, for fixing a lamp 10 to the opposite ends of the lamp assembly 1, and a lamp 10 inserted in the lamp fixing member 20 and illuminated when electrical power is supplied.

However, the diameter of the lamp is smaller than that of a conventional lamp, the electronically fluorescent lamp generally has a compact construction, and all constituting elements are assembled.

The small diameter fluorescent lamp may be used for ornamental purposes as well as simple illumination. This kind of lamp is applicable to furniture.

An upper cover 30, is located over the lamp assembly having a circuit board (not shown), for opening/closing it. Multiple elastic hooks 4, protrude from the outer surface of the lamp assembly 1, mate with grooves 32 in the upper cover 30 to fasten the upper cover 30 to the lamp assembly 1. An installation groove 2, at one end of lamp assembly 1, is opened/closed by a stopper 3. Accordingly, when only one lamp assembly is used, the installation groove 2 is closed by the stopper 3, resulting in tidy exterior. Otherwise, when multiple lamp assemblies 1 are connected together, or when a plug for supplying electric power is connected, the stopper 3 is removed so that the installation groove 2 is a junction.

As shown in FIG. 1, a hook 24 protrudes from the top of the lamp fixing member 20, and is detachably coupled to a corresponding groove (not shown) in the lamp assembly.

The lamp fixing member 20 contains a key slot 21 located at the lower portion thereof, and a key 22 inserted in the key slot. The fluorescent lamp is inserted/extracted into/out of the lamp assembly through key slot 21 after removing key 22. Key 22 closes key slot 21 after the fluorescent lamp 10 is inserted so that the fluorescent lamp is not extracted from the lamp assembly.

Key 22 is essential for safety. Therefore, some countries require that the fluorescent lamp 10 not be extracted from the lamp assembly. In this regard, key 22 which seals the key slot, meets the above mentioned safety regulations.

After installing the fluorescent lamp 10, a fluorescent lamp cover 60 is installed at the outer portion of the lamp 10 for the purpose of reflection of fluorescent light or indirect illumination.

A protruding portion 61, on the inner opposite ends of the fluorescent lamp cover 60 which is made of transparent or translucent plastic, mates with groove 23 on the outside of the lamp fixing member 20.

As illustrated in FIG. 1, bracket 70 is used to attach the lamp assembly 1 to a surface.

After brackets 70 are fastened at the location where the lamp assembly 1 should be installed, by inserting a screw through a hole 72, the lamp assembly 1 is pushed to the brackets 70 and held securely with hooks at the open ends of the channel shaped bracket 70.

Hooks 73 at the open end of the channel shaped bracket 70 seize protruding ends of the upper cover 30 coupled to the lamp assembly 1.

Long grooves 31 in the upper cover 30 add the reinforcement force with the corrugated surface 4 formed by the long grooves 31 to the cover 30 in order to prevent the cover 30 from bending. When lamp assembly 1 is installed on a wall vertically, a protrusion 71 on the upper inner surface of the bracket 70, moves along the long grooves 31 on the upper cover 30 until it stops at the ends of the cover 30, preventing the cover 30 from moving any further. Thereafter, lamp assembly 1 can be installed vertically without removing cover 30.

The connection between adjacent lamp assemblies is achieved with a connector 40 inserted into mating ends of the lamp assemblies and a coupler 50 coupling the connectors 40.

Connector 40, which is inserted into the installation groove, contains a pair of electrical terminals 41, which make contact with the circuit board, (not shown) installed in the lamp assembly.

A bent conductor 42 contacting opposite sides of the connector 40 connects the circuit board (not shown), and a terminal contact portion protruded downward is contacted with the end terminals of the lamp 10 by being inserted in the lamp fixing member 20. As a result, the connector 40 and the lamp assembly 1 are assembled with each other.

The box-shaped coupler 50, which couples the connectors 40, contains a partition 51 installed in the center thereof, and U-shaped conductive clips 52 installed therein.

Figure 2:
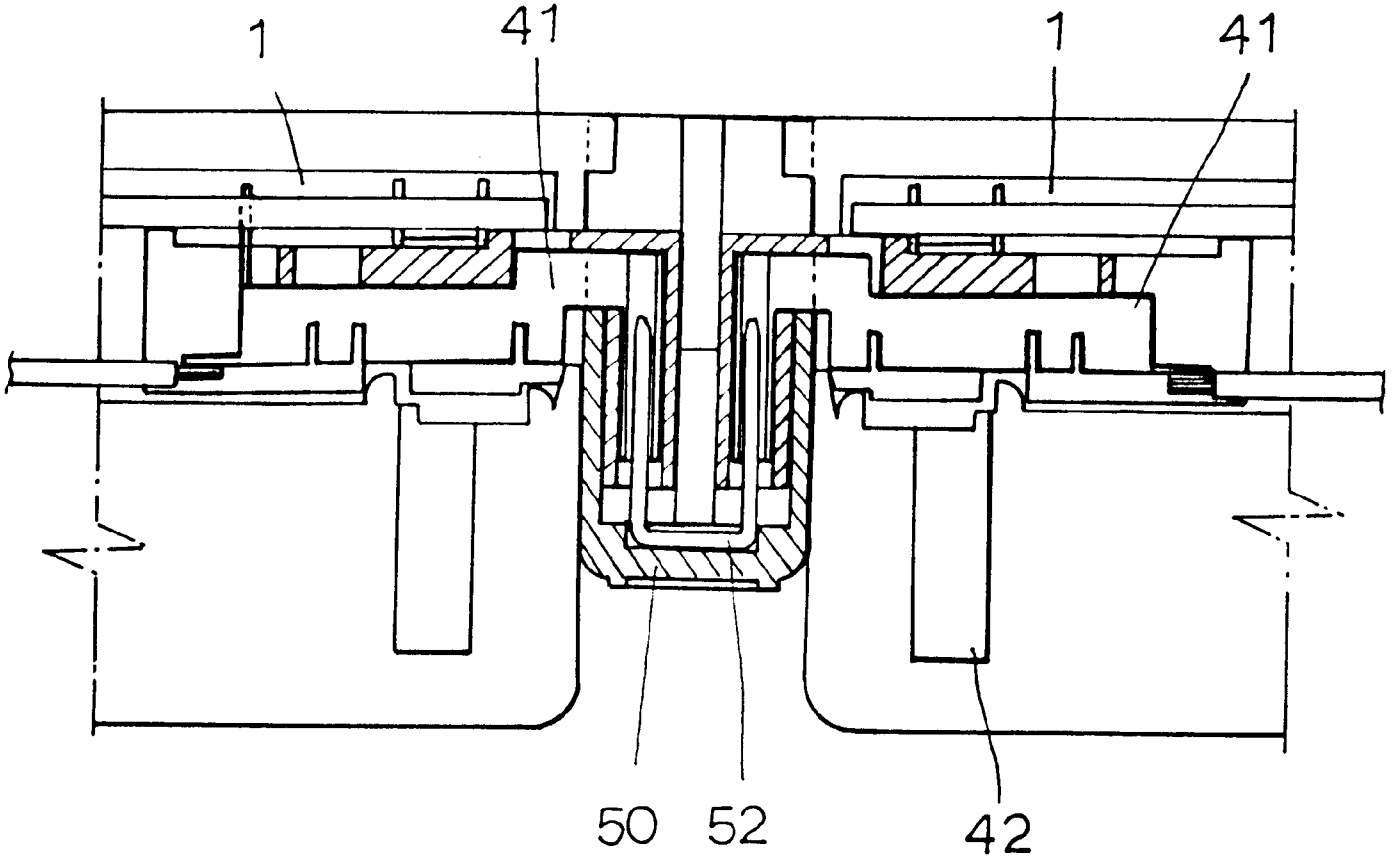
FIG. 2 is a cross-section of the present invention where lamp assemblies are connected with a coupler.

Accordingly, the connector 40 is inserted through the clips 52 to electrically connect the connectors attached to the corresponding lamp assemblies, as shown in FIG. 2.

In this state of connection, when the coupling member 50 is removed, power is not transferred between the lamp assemblies allowing the lamp assembly that is malfunctioning to be replaced.

Connectors 40 and the coupler 50, coupling connectors 40, are made of reinforced plastic, because these materials are not affected by heat, to prevent poor contact between the terminal members due to contraction or expansion of the terminal members.

Figure 3:
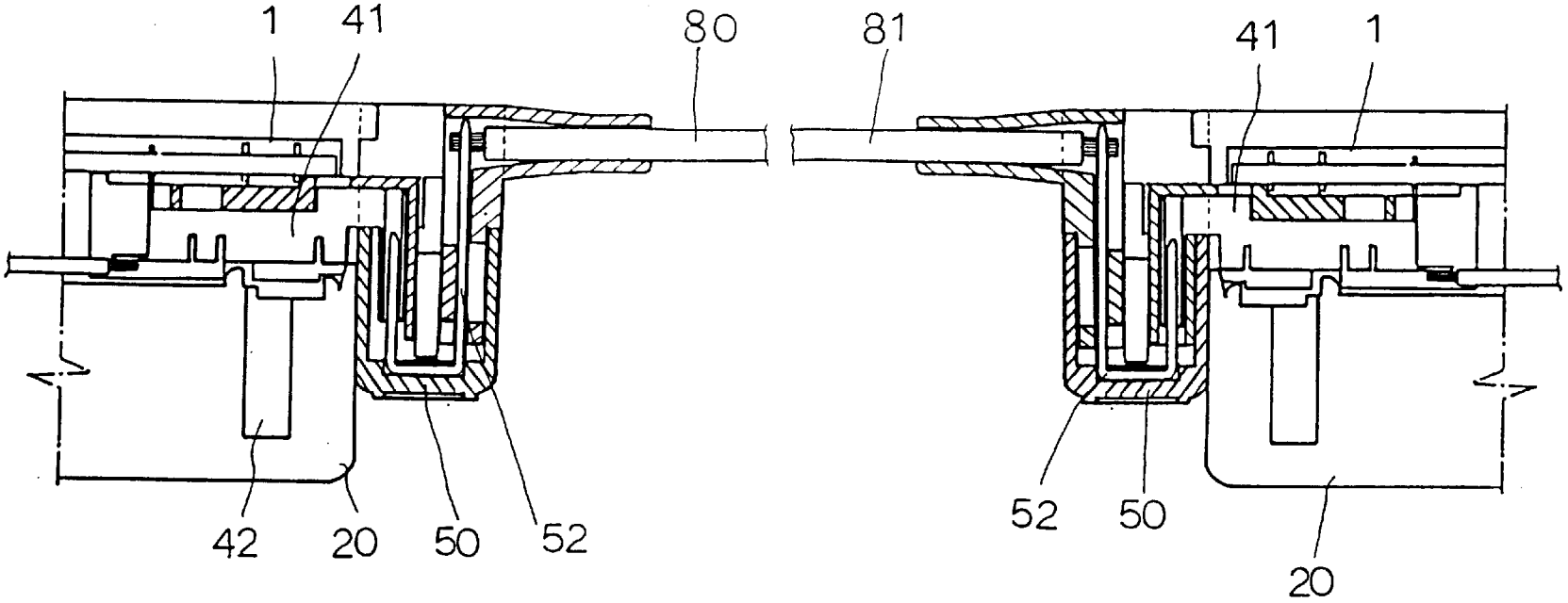
FIG. 3 is a cross-section of another embodiment of the present invention where lamp assemblies are connected at fixed intervals with a coupler.

FIG. 3 shows the main bodies 1 of fluorescent lamps connected at a fixed interval.

The electric power between the lamp assemblies can be connected by means of an electric wire 81, with a fixed length connected with connecting cable 80 inserted into one side of coupler 50.

Accordingly, the fluorescent lamp can be installed perpendicularly or however desired.

Figure 4:
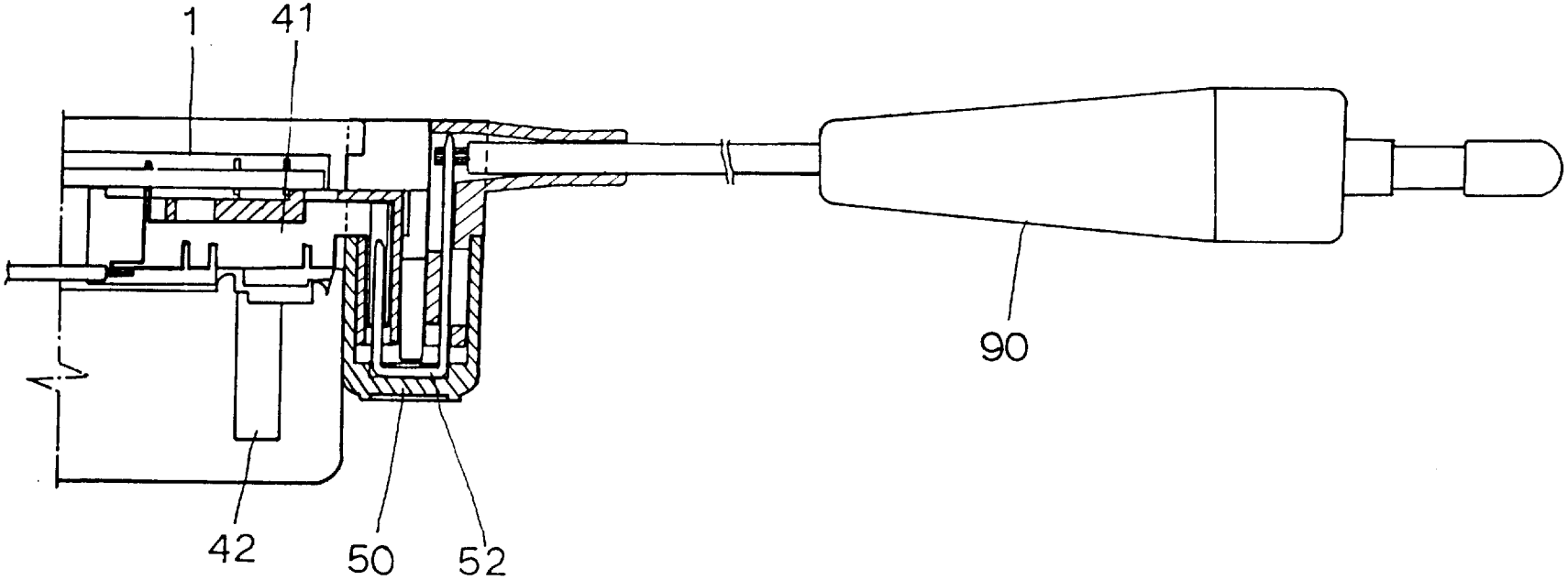
FIG. 4 is a cross-section of the present invention where a lamp and a plug are connected each other.

Instead of the electric wire of FIG. 3, a plug 90 is installed at one end of the connecting cable 80 as shown in FIG. 4.

In addition, the lamp can be turned on/off by a separate electric power switch installed on the electric wire 81.

According to the embodiments of the present invention, the fluorescent lamp can be replaced, and the lamp assembly is easily exchanged so that the lighting fixture can be used for a long time. When the lamp is replaced, the lamp assembly need not be replaced, thereby decreasing the cost. When a lamp malfunctions, only the lamp part of the lamp assembly of the lamp is replaced, it need not be disassembled and only one part thereof can be easily replaced. Also, the present invention provides a convenient connection between the connecting member, and no poor operation resulting from the transmission of heat.

It will be apparent to those skilled in the art that various modifications and variations can be made in a fluorescent light fixture of the present invention without departing from the spirit or scope of the invention. Thus, it is intended that the present invention cover the modifications and variations of this invention provided they come within the scope of the appended claims and their equivalents.

What is claimed is:

1. A fluorescent light fixture including: a lamp assembly; a lamp fixing member for connecting the lamp by inserting it into both ends of the lamp assembly, including a key slot, and a key for opening/closing the key slot so that the lamp can be removed from the lamp assembly through the key slot; an upper cover covering the top surface of the lamp assembly; a connector connected to said lamp fixing member through an installation groove at one end of the lamp assembly; and a coupler coupling said connector to other similar connectors.

2. The light fixture as defined in claim 1, wherein a transparent or translucent fluorescent lamp cover is additionally installed at the lamp assembly into which the lamp is inserted.

3. The light fixture as defined in claim 1, wherein a pair of channel shaped brackets are elastically hooked onto the upper cover in order to attach the lamp assembly to a flat surface.

4. The lamp as defined in claim 3, wherein multiple long grooves in the upper cover, mate with protrusions on the mounting brackets so that the lamp assembly does not slide out of said mounting bracket.

5. The light fixture as defined in claim 1, wherein electric power is supplied through a connecting cable inserted into one side of the coupler, and a plug connected therewith.

6. The light fixture as defined in claim 5, wherein two lamp assemblies are connected at a fixed interval with a connecting cable, where instead of a plug at one end, a connector connects to the second lamp assembly.

7. The light fixture as defined in claim 1, wherein multiple elastic hooks protruded from the upper portion of the lamp assembly and are inserted into insertion grooves of the upper cover to fasten the upper cover.

* * * * *